US005464955A

United States Patent [19]

Cole

[11] Patent Number: 5,464,955

[45] Date of Patent: Nov. 7, 1995

[54] BACKLIT APPLIANCE CONTROL CONSOLE

[75] Inventor: Ronald E. Cole, Greenwood, Ind.

[73] Assignee: Emerson Electric Co., St. Louis, Mo.

[21] Appl. No.: 395,282

[22] Filed: Jan. 9, 1995

Related U.S. Application Data

[63] Continuation of Ser. No. 47,318, Apr. 15, 1993, abandoned.

[51] Int. Cl.[6] ..... H01H 9/16

[52] U.S. Cl. ..... 200/317; 200/312

[58] Field of Search ..... 200/317, 316, 200/312, 311

[56] References Cited

U.S. PATENT DOCUMENTS

| | | | |
|---|---|---|---|
| 2,541,892 | 2/1951 | Schulze | 200/317 X |
| 2,607,873 | 8/1952 | Sheidler | 200/317 X |
| 2,648,305 | 8/1953 | Appleman | 200/317 X |
| 2,933,581 | 4/1960 | Naimer | 200/304 |
| 3,230,321 | 1/1966 | MeLann | 200/317 X |
| 3,393,657 | 7/1968 | Fukunishi | 116/124.1 |
| 3,566,063 | 2/1971 | McConnell | 200/304 |
| 3,902,375 | 9/1975 | Herrick et al. | 74/10.54 |
| 4,288,671 | 9/1981 | Morrison | 200/304 |
| 4,851,624 | 7/1989 | Chestnut et al. | 200/317 |

*Primary Examiner*—Renee S. Luebke
*Attorney, Agent, or Firm*—Eric R. Waldkoetter

[57] ABSTRACT

A household appliance operated by electromechanical controls has a control console that contains a light source to project light onto selected portions of a plastic control console faceplate to illuminate data such as appliance functions and control settings. Data on the control console plastic faceplate can be illuminated upon the occurrance of a predetermined event and in different colors. Control knobs carry a plastic disk that has illuminated data, a clear selection window, and a translucent portion which aligns with illuminated data on the plastic control console faceplate.

10 Claims, 10 Drawing Sheets

FIG. 2A
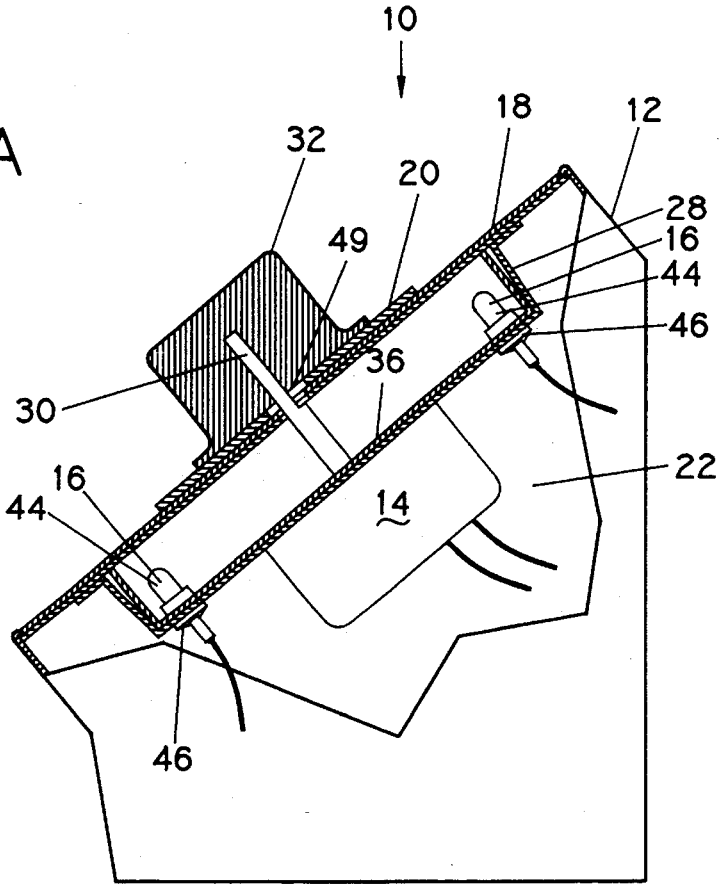
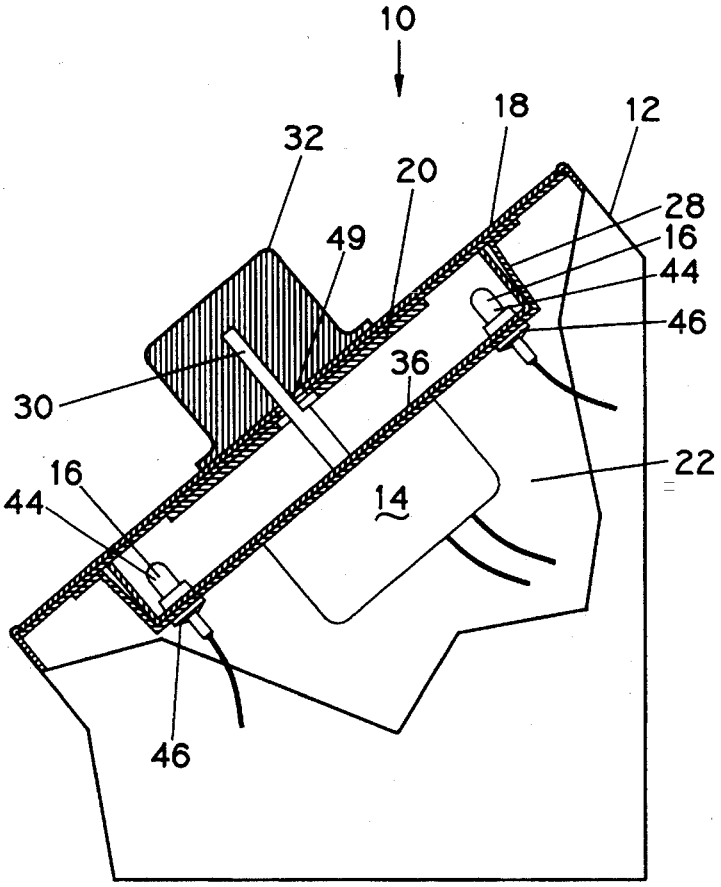
FIG. 2B

BACKLIT APPLIANCE CONTROL CONSOLE

This application is a continuation of application Ser. No. 08/047,318, filed Apr. 15, 1993 and now abandoned.

BACKGROUND

This invention relates to appliance control consoles and more specifically to household appliance control consoles such as those on clothes washing machines, clothes driers, and dishwashers having control knobs on the control console that can be set by an operator.

Household appliances are often located in low-light areas such as utility rooms or under counters. Low-light conditions can make it difficult to read appliance functions and control settings or positions. If an appliance control is set improperly due to low-light conditions, the appliance may not perform as expected by the operator or the appliance may run longer than necessary and waste energy.

Previous appliance control consoles have used lights mounted on the exterior of the control console to floodlight controls on the control console, so an operator could read controls in low-light areas. Although a floodlighted control console will illuminate controls in a low-light area, floodlighting can cause glare making some controls more difficult to read at certain angles or annoy operators with light projecting from the appliance control console.

Previous appliance controls have placed neon lights beneath a control dial to illuminate the control dial. While the control dial is illuminated by this backlighting technique, the rest of the control console remains unlit. An unlit control console may still possess the undesirable characteristic of making data labeled directly on the control console difficult to read. An example of a backlit appliance control dial can be found in a KitchenAid® thermal convection oven model no. KEBS177X.

Some premium household appliances have solid state controls that are typically annunciated with light emitting diodes (LEDs) or backlit liquid crystal displays. Although more expensive, such appliances controls can be seen easily in low-light areas and are more ergonomically friendly with different functions often represented by different color LEDs. The improved ergonomics of solid state controls is often a major reason for a customer to pay the premium price for solid state controls rather than purchase an appliance with electromechanical controls although many consumers find analog controls easier to operate.

What is needed is a technique of backlighting the appliance control console and control dials to permit easy reading in low-light areas, and simulate the improved the ergonomics of a solid state controlled appliance with color illumination to represent different appliance functions while maintaining the ease of operation associated with analog controls.

SUMMARY

I have invented an apparatus and method that satisfies the need for an appliance console with a backlit control console and control dials to permit easy reading in low-light areas and to improve the ergonomic feel of the control console with different color illumination to represent different appliance functions.

A backlit appliance control console apparatus comprises the following elements: a housing having an interior and a control console; one or more controls for selecting appliance functions are mounted in the housing interior and have shafts extending through the control console; a light source is carried in the housing; and a console annunciator receives light from the light source to illuminate data indicating appliance function and has openings through which control shafts protrude. An additional element may be a control annunciator receiving light from the light source to illuminate data on the control for indicating control position.

The method of backlighting an appliance control console comprises the following steps: a housing is provided having an interior and a control console; an opaque console annunciator is provided with selected translucent portions having data written on some or all selected translucent portions and mounted to the control console; a light box is provided mounted in the housing interior carrying a light source to illuminate selected translucent portions of the opaque console annunciator; one or more controls is provided having a control shaft extending through the light box and the opaque console annunciator with the control mounted in the housing interior; appliance functions are annunciated by the light source illuminating data written on selected translucent portions of the opaque console annunciator. The method of backlighting an appliance control console may further comprise the step of annunciating control position by the light source illuminating data on the control indicating control position.

The following are objects of the invention. Improved visibility of appliance controls under low-light conditions. Improved ergonomics with a lighted color display for use with electromechanically controlled appliances. Improved more modern looking appliance display for use with electromechanically controlled appliances.

BRIEF DESCRIPTION OF THE DRAWINGS

These and other features, aspects, and advantages of the present invention will become better understood with regard to the following description, appended claims, and accompanying drawings where:

FIG. 2A shows a side view of the backlit appliance control console with a control annunciator positioned above a console annunciator;

FIG. 2B shows a side view of the backlit appliance control console with the control annunciator positioned below a console annunciator;

DETAILED DESCRIPTION

Figure 1A:
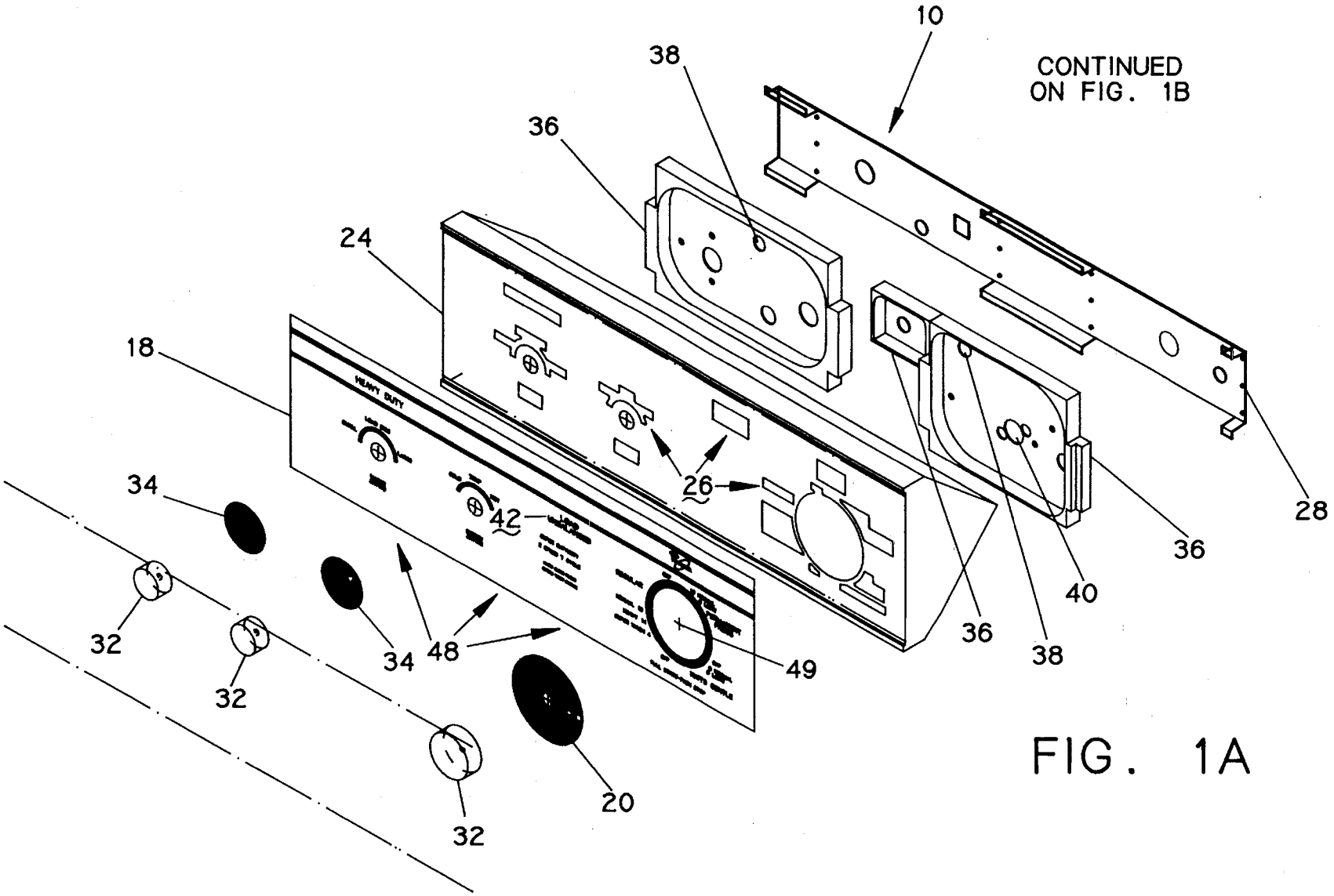
FIG. 1A shows an isometric, exploded view of a portion of a backlit appliance control console.
Figure 1B:
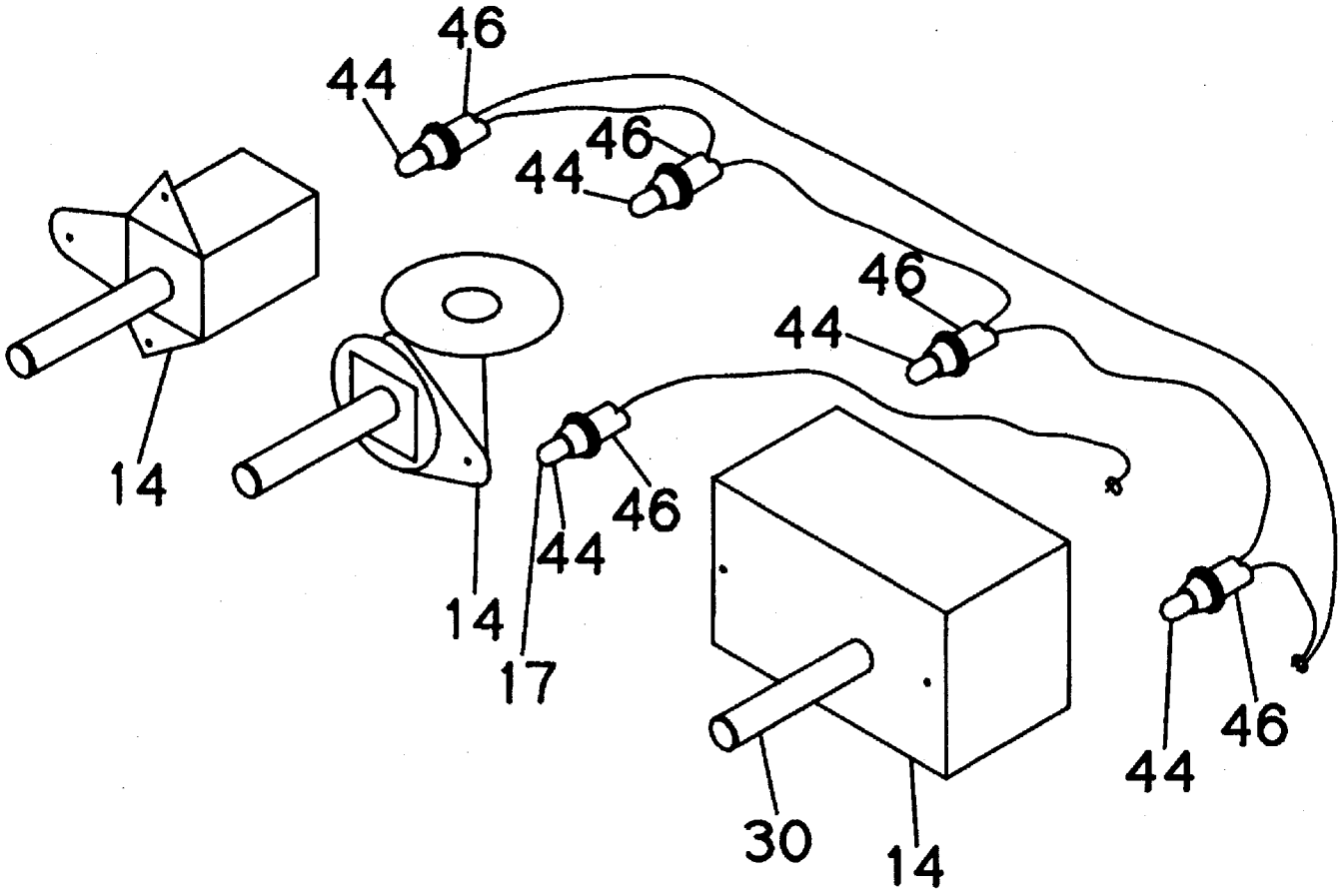
FIG. 1B shows an isometric, exploded view of a remaining portion of the backlit appliance control console.

Referring to FIGS. 1A–B and 2A–B, a backlit appliance control console 10 comprises: a housing 12, a control 14, a light source 16, a console annunciator 18, and a control annunciator 20. The housing 12 has an interior 22 and a control console 24 for attaching the console annunciator 18. The control console 24 has cut-outs 26 to permit mounting the control 14 or multiple controls 14 and to permit the light source 16 to project light through the control console 24 to illuminate selected portions of the console annunciator 18 and the control annunciator 20. Control console cut-outs 26 can be configured as desired to permit mounting controls 14 at various locations in the housing 12 and to permit the light source 16 to project light through the control console 24 to illuminate desired portions of the console annunciator 18 and control annunciator 20. Since most of the control console is solid, except for cut-outs 26, the control console 24 also serves as a safety barrier between the appliance operator and electrified components. A channel plate 28 is attached to the control console 24 with brackets (not shown) in the housing interior 22 to provide a rigid structure for mounting controls 14 and to retain light source 16 components. Both the housing 12 and the channel plate 28 are typically stamped sheet metal.

The control 14 mounted in the housing interior 22 has a shaft 30 extending through the control console 24 for selecting appliance functions. The control 14 can be several controls 14 with each control 14 typically having a control knob 32 mounted on the shaft 30. The control 14 is mounted to the channel plate 28 with screws (not shown). The control 14 is typically an electromechanical control or a hybrid electromechanical control containing electronics, such as a cam-operated timer used to control appliance functions of a multi-function rotary switching mechanism used to set electronic controls known as an encoder. Appliance functions can include such operations as a programmed sequence of appliance, e.g., washing cycles or drying cycles; appliance warnings, e.g., load unbalanced or lint collector full; and, appliance control 14 selections, e.g., water temperature, load size, or energy savings features. Controls 14 may also include one or more multiposition switches to select such appliance functions as water level and temperature.

The light source 16 is carried in the housing interior 22. The light source 16 can be carried in a light box 36 wherein the light box 36 is mounted in the housing interior 22. Light boxes 36 are typically molded from nylon and are open on one side for directing light through control console cut-outs 26 to predetermined portions of the console annunciator 18 and control annunciator 20. Light boxes 36 could have internal compartments (not shown) so light generated by a particular light source 16 would not illuminate the entire light box 36. The light box 36 also has light source openings 38 for mounting the light source 16 and control openings 40 for control shafts 30 to extend through the light box 36. Light boxes 36 are carried between the housing control console 24 and the channel plate 28. Since the control console 24 is fully enclosed, light that may leak from the fit between the light box 36 and control console 24 is not generally projected outside the control console 24. A light gasket (not shown) could be placed between the light box 36 and the control console 24 to reduce light leakage.

Fiber optics (not shown) could be used to channel light from the light source 16 to predetermined areas of the console annunciator 18, control annunciator 20 or other portions of the appliance. A separately controlled light source 17 may be configured to illuminate portions of the console annunciator 18 for an information notice 42 only upon the occurrence of predetermined conditions such as a load unbalanced, a full lint collector, or activation of an energy saving feature. Two or more separately controlled light sources 17 can be configured to receive inputs from controls 14 to illuminate portions of the console annunciator 18 when predetermined conditions exist.

The light source 16 can be four (4) 28 VAC rated lamps 44 wired in series for a 110 VAC nominal application. Lamps 44 should have a life average hours of at least 2,500–7,000, or approximately the life average hours the appliance is designed to last, so lamps should not have to be replaced for the life of the appliance. The lamp sockets 46 can be automotive type wedge base bulb and snap-in socket. Lamps 44 and lamp sockets 46 such as those described above are available from JKL Components Corporation, part nos. 655 and 2964-8B respectively at 13343 Paxton Street, Pacoima, Calif. 91331-2376.

The console annunciator 18 receives light from the light source 16 to illuminate data 48 indicating appliance functions and has openings 49 through which the control shaft 30 extends. The console annunciator 18 serves as the appliance faceplate. Data 48 indicating appliance functions can be shapes, numbers, letters, words, colors, or any combination of these. The console annunciator 18 is plastic, typically a polycarbonate resin film such as General Electric Lexan® HP92S which is approximately 0.015 inch (0.038 cm) thick available from General Electric Company, Plastics Group, One Plastics Avenue, Pittsfield, Mass. 01201. The console annunciator is made by applying an opaque ink in a color such as black to selected areas of the clear polycarbonate film and by applying a translucent ink in colors such as red, blue, green, and yellow to other selected areas of the clear polycarbonate film. Both the opaque ink or the translucent ink or a combination of both can be used to create data 48. Data 48 can indicate control 14 functions such as control 14 labels and control 14 positions. Locations on the polycarbonate film which are desired to contain a color other than the first color such as black are left blank. After the first color, typically black, silk screening is completed, additional colors are silk screened over the blank spaces such as red to indicate hot, blue to indicate cold, green to indicate start, and yellow to indicate information or warning.

The polycarbonate film can be attached to the control console with a screenable self-adhesive such as Serigraph® 2500/1 solvent-borne screened adhesive, available from Serigraph®, 760 Indiana Avenue, P.O. Box 438, West Bend, Wis. 53095, or 3M® 467 or an equivalent. Adhesive is not applied to areas of the console annunciator which will receive light to illuminate data or colors.

The silk screening technique of placing data and colors on the console annunciator 18 permits rapid changes in design for greater manufacturing flexibility. Additionally, since different console annunciators 18 may be used on different appliance models, an inventory of console annunciators 18 can be maintained much more easily that an inventory of entire housings 12.

Figure 3:
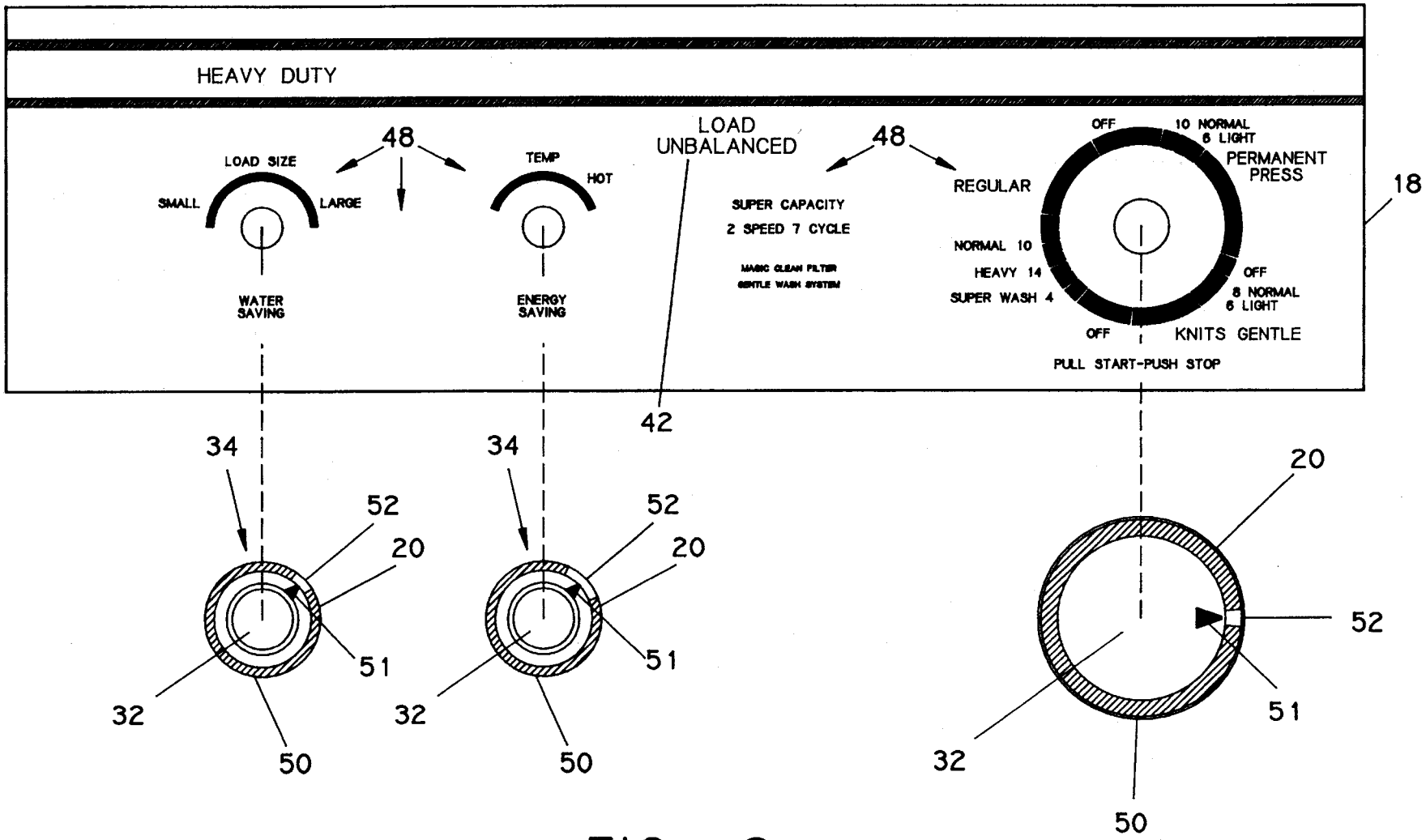
FIG. 3 shows a front view of the backlit appliance control console.
Figure 4:
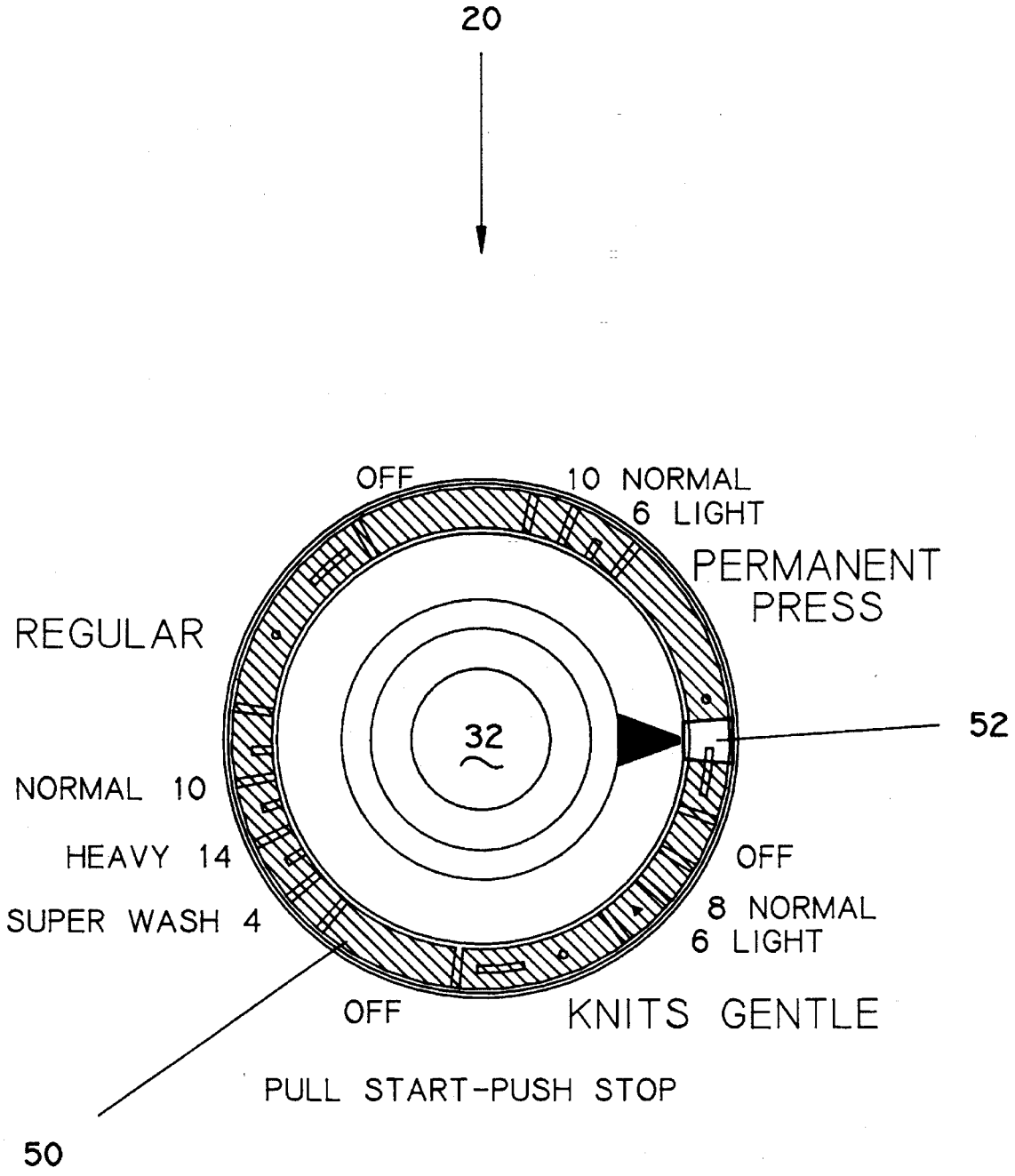
FIG. 4 shows an enlarged view of a control annunciator.
Figure 5:
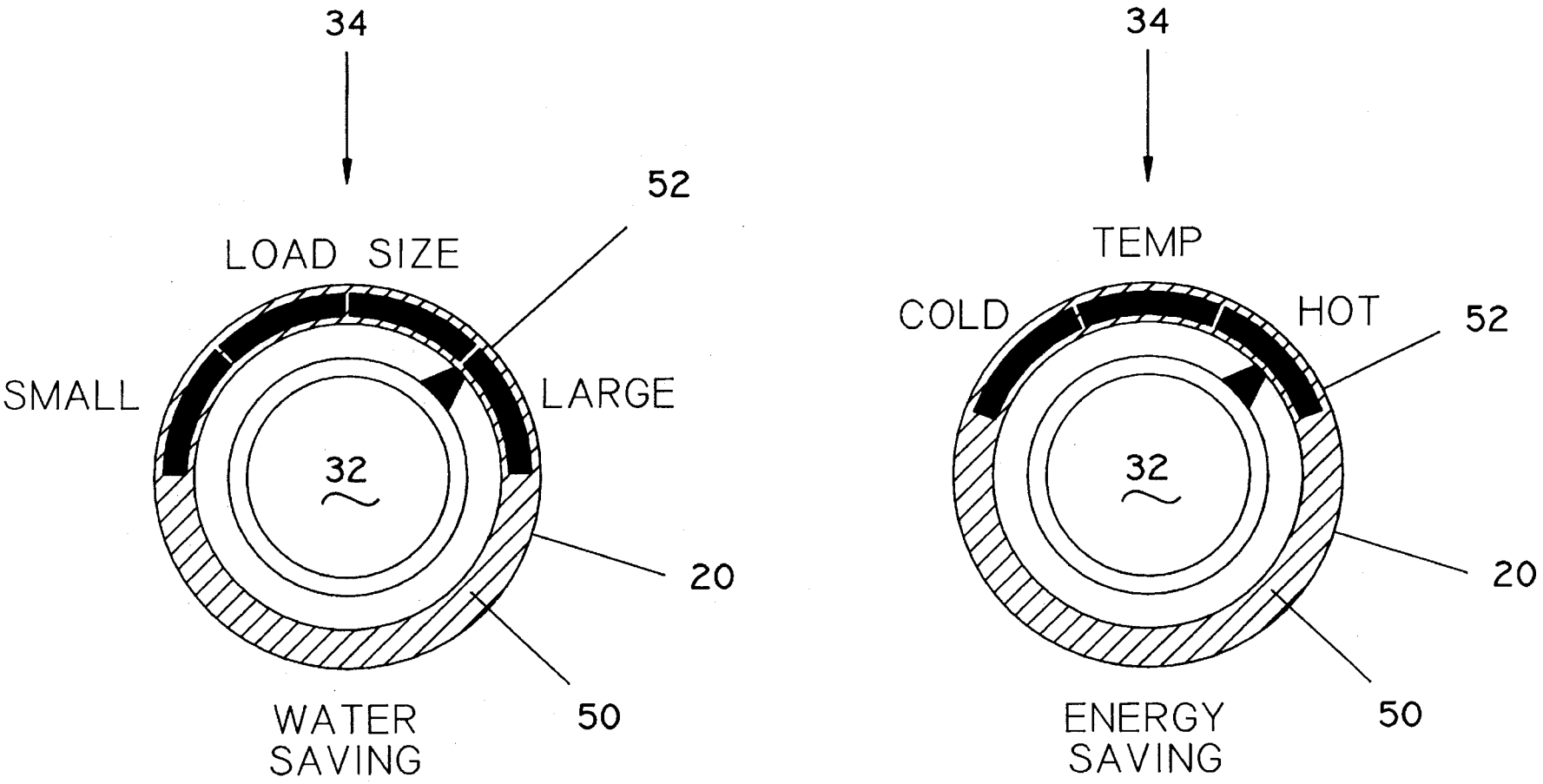
FIG. 5 shows an enlarged view of multiposition switches.
Figure 6:
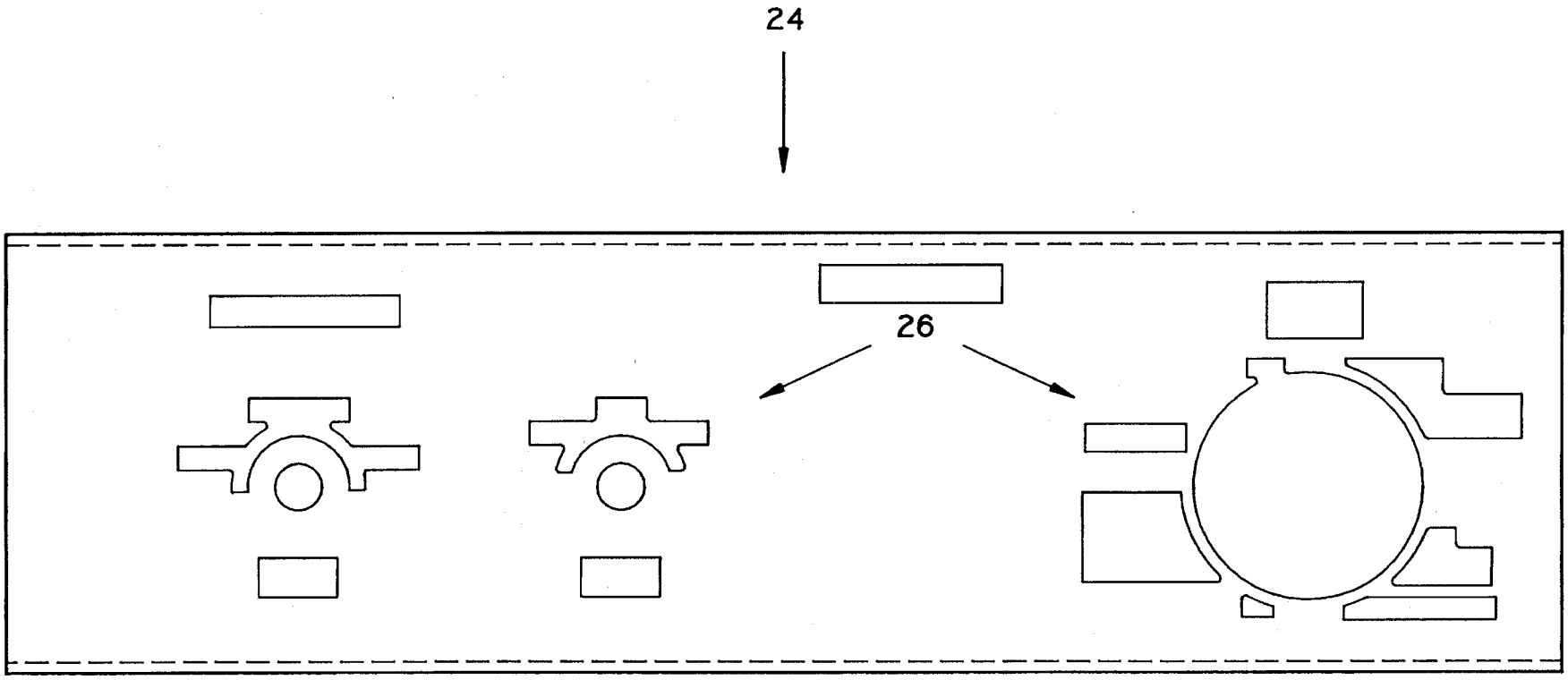
FIG. 6 shows a housing control console.
Figure 7:
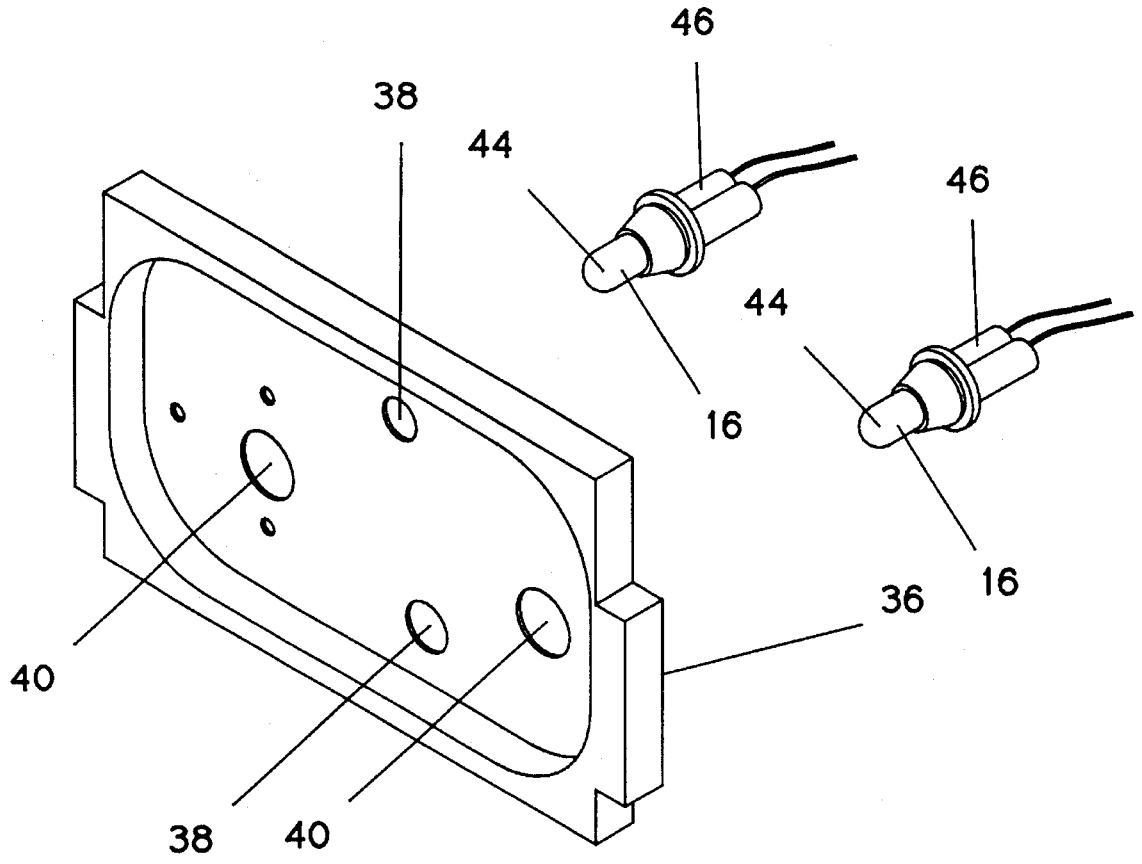
FIG. 7 shows a light box and light source.
Figure 8:
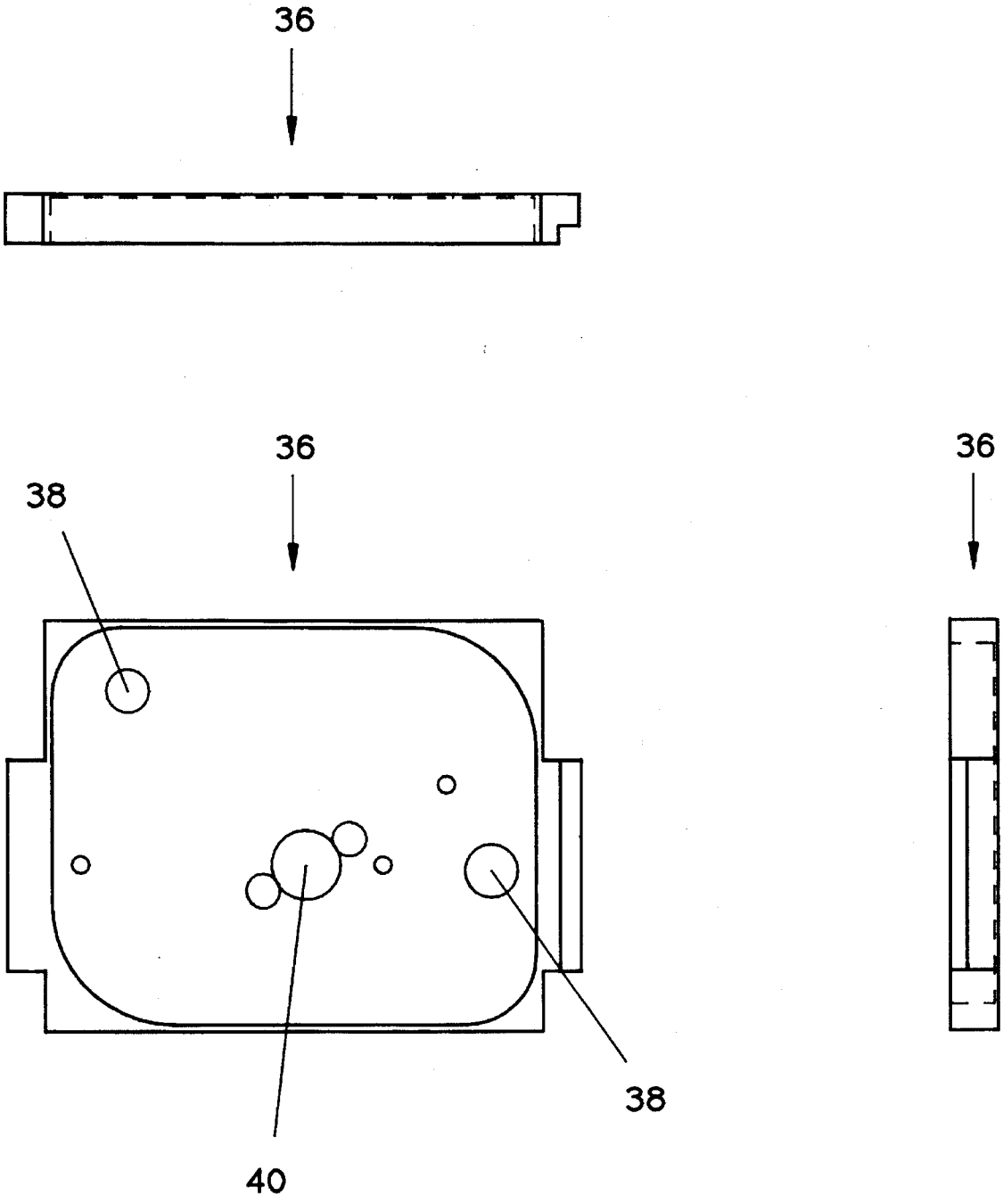
FIG. 8 shows another light box.
Figure 9:
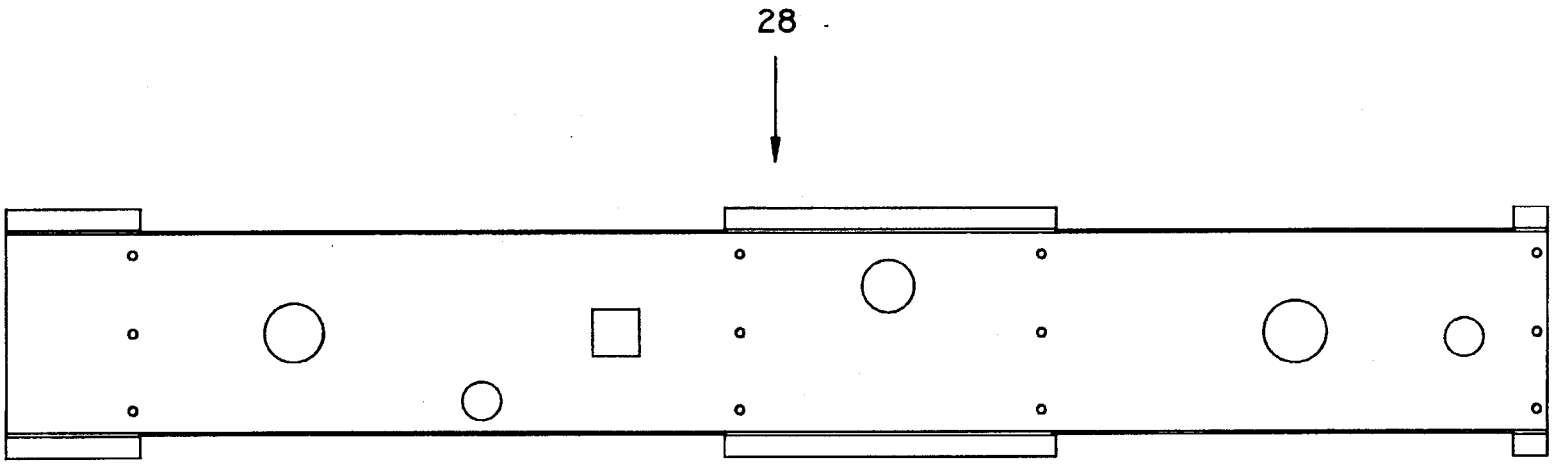
FIG. 9 shows a front view of a channel plate.
Figure 10:
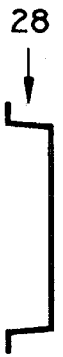
FIG. 10 shows a side view of a channel plate.

Referring to FIGS. 1A–B, 2A–B and 3, the control annunciator 20 receives light to illuminate data on the control annunciator 20 for indicating control 14 position relative to data 48 on the console annunciator 18. Data 51 on the control annunciator 20 can be shapes such as an arrow, numbers, letters, words, colors, or any combination of these. The control annunciator 20 is a circular transparent plastic typically an injection moldable acrylic skirt attached to a control shaft 30 that extends through the control console 24 and console annunciator 18. The control annunciator 20 typically has a center hole (not shown) which permits slipping the control annunciator 20 over the control shaft 30 that extends through the console annunciator 18. The control annunciator 20 also has a key hole (not shown) which is designed to line up with a control knob 32 key (not shown) to properly align the control annunciator 20 position with the control 14 position. The majority of the control annunciator 20 is translucent 50 and another portion is clear to serve as a selection window 52. The portion of the control annunciator 20 that is translucent 50 can made so by silk screening a dot or cross-hatched pattern onto the control annunciator 20. Some of the data 48 illuminated by the console annunciator 18 is aligned directly beneath the control annunciator 20. Console annunciator data 48 aligned beneath the translucent portion of the control annunciator 20 is typically readable by the operator but deemphasized as compared to the data beneath the selection window 52.

When the control 14 is rotated by the appliance operator to set an appliance function such as a wash cycle, the control annunciator 20 rotates with the control 14 and the operator selects a function by halting rotation when the function to be selected can be viewed through the selection window 52.

Referring to FIG. 2B, the control annunciator 20 can be positioned on the control shaft 30 under the console annunciator 18. When positioned below the console annunciator 18, the control annunciator 20 would function in much the same way as when positioned on the exterior of the console annunciator 18. The selection window 52 in the control annunciator 20 would cause the light that projects through the selection window 52 onto the console annunciator 18 to be of greater intensity to indicate control 14 position than the light projected through the translucent portion 50 of the control annunciator 20.

Referring to the figures, operation of the backlit appliance control console is now described. The appliance operator activates (turns "on") the light source 16 by pulling out the knob 32 on a control 14, typically the appliance function control 14. The light source 16 could also be activated by a separate "on" switch or some other switch on the appliance (not shown). Light boxes 36 channel light through control cutouts 26 in the control console 24 to illuminate predetermined portions of the console annunciator 18 and control annunciator 20. The console annunciator 18 displays available appliance functions by the light source 16 illuminating data 48 written on selected portions of the console annunciator 18. The control annunciator 20 displays the control 14 position in the selection window 52.

With the light source 16 activated, the appliance operator can identify and select appliance functions and control 14 settings. Appliance functions are easy to identify even in poorly lighted areas because the appliance functions on the console annunciator 18 are illuminated. Appliance functions are selected by rotating the appropriate control 14 until the appropriate appliance function appears in the selection window 52 on the control annunciator 20.

The appliance operator's attention is drawn to the selection window 52 by data 51 such as an arrow on the control annunciator 20 that points to the selection window 52. Since the selection window 52 of the control annunciator 20 is clear and the remainder of the control annunciator is translucent 50, the appliance function under the selection window 52 appears brighter than the appliance functions that appear under the translucent 50 portion of the control annunciator 20.

The previously described versions of the present invention have many advantages, including: many of the ergonomic advantages of a solid state controlled appliance without the increased cost; improved appliance control and function visibility in poorly lit areas; the air of sophistication of a solid state controlled appliance without the increased cost; and, a smooth appliance control panel that is easy to clean.

Although the present invention has been described in considerable detail with reference to certain preferred versions thereof, other versions are possible. For example the control annunciator could be carried on the control shaft beneath the console annunciator; and, a variety of colors could be silk screened onto the console or control annunciator to convey data. Therefore, the spirit and scope of the appended claims should not be limited to the description of the preferred versions contained herein.

What is claimed is:

1. A backlit appliance control console, comprising:

(a) a housing having an interior and a control mounting plate with control openings and light windows;

(b) a light source carried in a light box in the housing interior projecting light through the light windows; and, (c) a multi-function rotary switching mechanism carried in the housing interior and mounted to the control mounting plate having a shaft extending through one of the control openings and the light box for selecting appliance functions;

(d) a console annunciator carried by the control mounting plate for receiving light from the light source projected through the light windows and the light box to illuminate selected areas with data indicating appliance functions, the console annunciator having at least one opening through which the shaft extends; and, (e) a control annunciator disposed around the periphery of the shaft between a control knob and the console annunciator for receiving light from the light source to illuminate data indicating control positions in relation to illuminated data on the console annunciator.

2. The backlit appliance control console as recited in claim 1 wherein the control annunciator permits viewing available appliance functions while identifying the control position.

3. The backlit appliance control console as recited in claim 1 wherein the control annunciator is plastic.

4. The backlit appliance control console as recited in claim 1, wherein the control console further comprises: a light channel for directing the light to designated areas of the console annunciator.

5. The backlit appliance control console as recited in claim 1 wherein the console annunciator is plastic.

6. The backlit appliance control console as recited in claim 1, further comprising: an information notice that is illuminated when a predetermined appliance condition is met.

7. The backlit appliance control console as recited in claim 1 wherein the console annunciator contains data indicating appliance functions in color.

8. The backlit appliance control console as recited in claim 7 wherein the console annunciator contains data indicating appliance functions in the color red.

9. A method of annunciating functions in a home appliance with light, comprising the steps of:

(a) providing a housing having an interior and a control mounting plate with control openings and light windows;

(b) providing a light box mounted in the housing interior carrying a light source to project light through the light windows;

(c) providing a multi-function rotary switching mechanism carried in the housing interior and mounted to the control mounting plate having a control shaft extending through the light box and a console annunciator;

(d) providing an opaque console annunciator with selected translucent portions mounted to the control mounting plate having data written on selected translucent portions;

(e) providing a control annunciator mounted on the control shaft;

(f) annunciating appliance functions by the light source illuminating data written on selected translucent portions of the opaque console annunciator; and, (g) annunciating control position by the light source illuminating data on the control annunciator indicating control position in relation to illuminated data on the opaque console annunciator.

10. The backlit appliance control console as recited in claim 9 wherein the multi-function rotary switching mechanism is a cam-operated timer.

* * * * *